United States Patent [19]

Vossieck et al.

[11] Patent Number: 4,531,483

[45] Date of Patent: Jul. 30, 1985

[54] LIP SEALING RING IN AN INTERNAL COMBUSTION ENGINE

[75] Inventors: Paul Vossieck; Hans Deuring, both of Burscheid, Fed. Rep. of Germany

[73] Assignee: Goetze AG, Burscheid, Fed. Rep. of Germany

[21] Appl. No.: 668,161

[22] Filed: Oct. 31, 1984

Related U.S. Application Data

[63] Continuation of Ser. No. 416,713, Sep. 10, 1982, abandoned.

[30] Foreign Application Priority Data

Sep. 18, 1981 [DE] Fed. Rep. of Germany ..... 3137135
Jun. 14, 1982 [DE] Fed. Rep. of Germany ..... 3222356

[51] Int. Cl.[3] ..... F01L 3/08

[52] U.S. Cl. ..... 123/188 P; 277/9.5; 277/152

[58] Field of Search ..... 123/188 R, 188 P, 166, 123/188 VA; 251/214, 358; 29/157.1 A; 277/1, 9, 9.5, 11, 152, 179, 153

[56] References Cited

U.S. PATENT DOCUMENTS

| | | | |
|---|---|---|---|
| 2,208,482 | 7/1940 | Victor | 277/152 |
| 3,333,578 | 8/1967 | Müller | 123/188 P |
| 3,363,952 | 1/1968 | Paterson | 277/153 |
| 3,531,134 | 9/1970 | Rammeraad | 123/188 P |
| 3,554,180 | 1/1971 | Lesser | 123/188 P |
| 3,699,942 | 10/1972 | Moray | 123/188 P |
| 3,947,944 | 4/1976 | Washington | 277/1 |
| 4,218,813 | 8/1980 | Cather | 277/11 |
| 4,403,778 | 9/1983 | Shevokas et al. | 277/9.5 |

FOREIGN PATENT DOCUMENTS

| | | | |
|---|---|---|---|
| 55-48007 | 7/1980 | Japan | 123/188 P |
| 569821 | 6/1945 | United Kingdom | 277/153 |
| 1181388 | 2/1970 | United Kingdom . | |
| 539154 | 12/1976 | U.S.S.R. | 123/188 P |

OTHER PUBLICATIONS

MTZ Motortechnische Zeitschrift [Automotive Magazine] 36 (1975) No. 12, pp. 326–329.

*Primary Examiner*—Charles J. Myhre
*Assistant Examiner*—R. S. Bailey
*Attorney, Agent, or Firm*—Spencer & Frank

[57] ABSTRACT

A lip sealing ring including a cylindrical elastic body having a sealing lip at one end and an attachment portion at the other end and a cylindrical reinforcing member having a first portion which includes an end face, a second portion having a smaller diameter than the first portion, and a shoulder portion joining the first and second portions. The reinforcing member surrounds the attachment portion and has only its inside surface bonded to the attachment portion. The reinforcing member is positioned such that the end face is located toward the sealing lip.

10 Claims, 4 Drawing Figures

LIP SEALING RING IN AN INTERNAL COMBUSTION ENGINE

This application is a continuation of application Ser. No. 06/416,713, filed Sept. 10, 1982 now abandoned.

BACKGROUND OF THE INVENTION

The present invention relates to a lip sealing ring, particularly a valve stem seal for a poppet valve in an internal-combustion engine, the seal having a body member made of an elastic material and having, preferably, a spring-tensioned sealing lip ring and a cylindrical reinforcing ring of metal or another material. The reinforcing ring includes an attachment point for receiving an installation punch.

The fastening of valve stem rings, with or without spring-tensioned sealing lip rings, on valve stem guides is effected by means of clamps, springs, or reinforcing rings or cylinders made of metal or another hard substance which are molded or bonded into the elastic valve stem seal body. During installation, the sealing member is pressed onto the valve stem guide with the aid of a cylindrical installation punch. In order for the installation punch to be able to grip the sealing ring, the reinforcing cylinder is provided with radially outwardly extending projections which serve as installation aids.

Valve stem seals are known which are equipped with holding and installation flanges at their reinforcing cylinders. According to British Patent Specification No. 1,181,388, for example, it is known to bend the upper portion of the reinforcing cylinder radially inwardly in the region between the lower portion of the reinforcing cylinder and sealing lip member so that the resulting shoulder is the attachment point for the installation punch. According to MTZ Motortechnische Zeitschrift [Automotive Magazine] 36 (1975) No. 12, pages 326–9, valve stem seals are known in which a reinforcing cylinder is molded or bonded into the valve stem seal elastic body member and forms a type of installation collar that is bent radially outwardly in the region between the lip member and the lower region of the valve stem seal elastic body member.

The drawbacks of valve stem seals with radially outwardly projecting installation aids are that they occupy relatively large amounts of space so that such valve stem seals cannot be used, for example, in engines having two valve springs where the radial space is rather limited. In addition, in special situations where the valve has already been inserted in the guide before the valve stem seal is pressed on the valve stem, the design of the installation punch is limited. Moreover, due to their method of manufacture, the bent portions have a relatively large drawing radius and the reinforcing rings are cut such that they have a relatively wide tolerance at their outer diameter. To bridge such tolerances, the outer jacket faces of such rings must be coated with elastomers. In addition, in valve stem seals having radially inwardly or outwardly bent reinforcing rings, there exists the danger that, in the region between the sealing lip member and the reinforcing cylinder, the relatively high specific a real pressure which occurs during installation will damage the bond between the metal reinforcing ring and the valve stem elastic body member so that the entire seal may fail.

SUMMARY OF THE INVENTION

It is therefore an object of the present invention to provide a lip sealing ring, specifically a valve stem seal for internal-combustion engines, whose metallic reinforcing cylinder occupies a relatively smaller area than was the case in prior art lip sealing rings and is provided with a seat for the installation punch without there existing the danger of destruction of the bond between the valve stem elastic body and metallic reinforcing cylinder during installation of the seal onto the valve stem. It is a further object of the invention to provide a lip sealing ring which can be manufactured with ease and at low cost.

This is accomplished by the present invention with a lip sealing ring having a cylindrical elastic body which includes a sealing lip at one end and an attachment portion at the other end and having a cylindrical reinforcing member which forms a type of crimped collar. The cylindrical reinforcing member has a first portion in its region oriented toward the sealing lip, a second portion having a smaller diameter than the first portion and a shoulder portion joining the first and second portions. The inner jacket face of the reinforcing cylinder is bonded to the cylindrical elastic body while the outer jacket face and the upper edge of the reinforcing cylinder are not covered with elastomer. The shoulder portion of the reinforcing cylinder is preferably positioned in the center region of the cylinder and extends to a length up to about 1/5 of the total length of the cylinder. The radial length of the bent portion, measured as a difference between the radii of the two cylinder halves, is preferably no greater than the radial wall thickness of the reinforcing cylinder so that during the manufacturing process the individual cylinders cannot be fitted in one another. The reinforcing cylinder may have a shape other than circular, such as the shape of a polygon, so that a radial spring is formed and a large tolerance is created between the lower portion of the lip sealing member and the valve seat permitting easy fitting of the lip sealing member on the valve seat. In other cases, particularly for manufacturing reasons, it has been found advantageous to make the reinforcing cylinders oval. In addition, it is possible to make only the second portion of the reinforcing cylinder noncircular in cross section if desired.

By shaping the reinforcing member with the crimped collar instead of a smooth collar, it is possible, due to the close diameter tolerance, to utilize the full radial space available. The installation forces are easily transferred from the installation punch, which rests on the upper edge of the cylinder which points toward the lip member, even if the punch rests only on a small circular ring surface. The invention also permits proper guidance of the valve stem seal in the installation punch and the use of a sealing lip and spring having sufficient dimensions to prevent damage of the valve stem sealing ring during the installation of the valve stem seals on the guide, even if, for technical production reasons, the valve has previously been inserted into its guide. In accordance with the invention, the bond between the elastic body and the reinforcing cylinder is such that it cannot be damaged as easily as before since the larger bonding surface between the elastic body and the reinforcing cylinder provides better protection against such destruction.

The invention, which is preferably to be used in connection with valve stem seals having relatively small diameters, can also be used for lip sealing rings in general which have similar dimensions and installation problems.

DETAILED DESCRIPTION OF THE PREFERRED EMBODIMENTS

Figure 1:
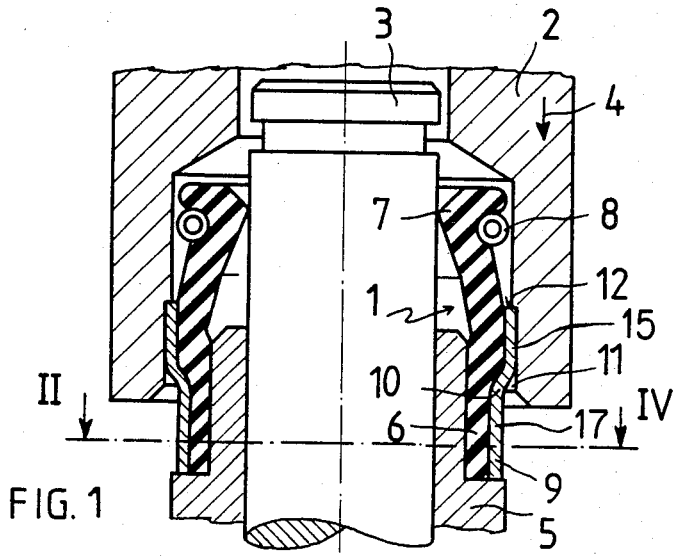
FIG. 1 is a sectional view of the valve stem seal according to the invention.

FIG. 1 shows a lip sealing ring 1 in the form of a valve stem seal which comprises a cylindrical elastic body 6 having a lip member 7 and a reinforcing cylinder 9 positioned at the lower portion of elastic body 6. An annular spring sealing lip ring 8 secures lip 7 to a shaft of valve stem 3. Cylindrical body 9 has only its inside surface bonded to elastic body 6. The valve stem seal 1 is pressed onto the shaft of valve stem 3 and a seat 5 by means of the installation punch 2 in the direction of the arrow 4. Cylinder 9 has an upper edge 12 which forms a base face. Cylinder 9 further includes a first portion 15 positioned toward lip member 7 and a second portion 17 having a diameter smaller than the diameter of the first portion. The first and second portions 15, 17 are joined by a crimped collar-like widening or shoulder portion 10. Installation punch 2 includes a recess 11 provided with a radial abutment face and during installation of the valve stem seal, force is transmitted from the abutment face of recess 11 of installation punch 2 to the upper edge 12 of the reinforcing cylinder 9 which is oriented toward the lip member 7.

Figure 2:
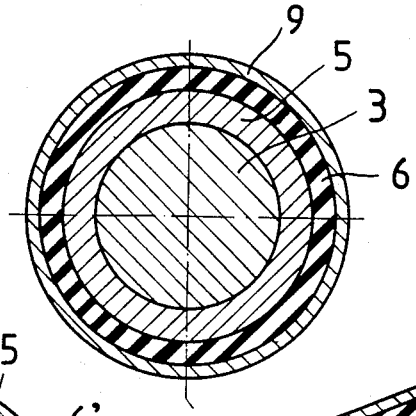
FIGS. 2, 3 and 4 are cross-sectional views of the valve stem seals seen along a section line, corresponding to section line II–IV of FIG. 1, mounted on the valve stem and having reinforcing rings of different cross-sectional configurations.

FIG. 2 shows the cross section of the reinforcing cylinder 9 having circular shaped second portion 17.

Figure 3:
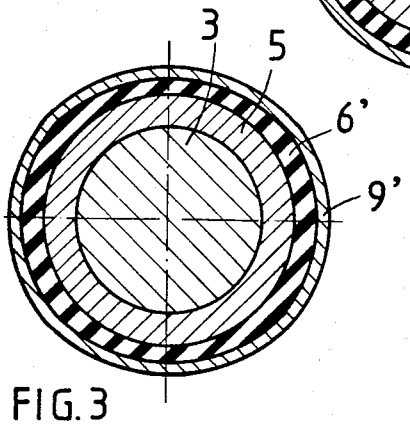
Figure 4:
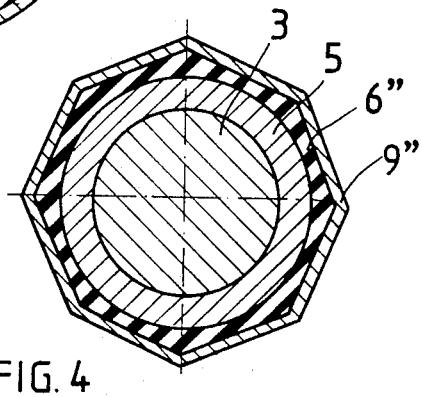

FIG. 3 shows a reinforcing cylinder 9' which has a second portion 17 of oval cross section, and FIG. 4 shows a reinforcing cylinder 9'' which has a second portion 17 of octagonal cross section. In all cases, however, the inner circumference of elastic body 6 is circular, even though in the embodiments of FIGS. 3 and 4 its outer circumference adjacent second portion 17 is oval or octagonal, respectively, to adapt to the shape of second portion 17, reinforcing cylinders 9' and 9''.

It will be understood that the above description of the present invention is susceptible to various modifications, changes and adaptations and the same are intended to be comprehended within the meaning and range of equivalents of the appended claims.

What is claimed is:

1. A lip sealing ring for placement, by an installation punch, on a cylindrical support disposed around the valve stem of a poppet valve in an internal combustion engine, comprising a cylindrical elastic body having a sealing lip at one end and an attachment portion at the other end; and a reinforcing member having a first portion with a wall having the form of a cylinder that is elongated in the axial direction thereof and that terminates in an end face constituting a base face of the cylinder, said end face being positioned to be in force transmitting engagement with the installation punch, a second portion with a wall having the form of an elongated cylinder that is disposed coaxially with respect to said first portion and that has a smaller diameter than said first portion, the wall thickness of said first and second portions in the radial direction being substantially equal, and a shoulder portion joining said first and second portions, said reinforcing member surrounding said attachment portion and having only its inside surface bonded to said attachment portion, said reinforcing member being positioned such that said end face is positioned toward said sealing lip.

2. The sealing ring of claim 1, wherein said shoulder portion lies approximately in the center of said reinforcing member and has a maximum longitudinal length of 1/5 the longitudinal length of said reinforcing member.

3. The sealing ring of claim 2 wherein the difference between the outside diameter of said first portion and the outside diameter of said second portion is no greater than the wall thickness of said reinforcing member.

4. The sealing ring of claim 1 wherein said second portion of said reinforcing member has a noncircular cross section.

5. The sealing ring of claim 1 wherein said second portion of said reinforcing member has a polygonal cross section.

6. The sealing ring of claim 1 wherein said second portion of said reinforcing member has an oval cross section.

7. The sealing ring of claim 1 wherein only said second portion of said reinforcing member has a noncircular cross section.

8. The sealing ring of claim 1, wherein the difference between the outside diameter of said first portion and the outside diameter of said second portion is no greater than the wall thickness of said reinforcing member.

9. The sealing ring of claim 1, wherein said shoulder portion is spaced apart from said end face by a distance that is substantially greater than the wall thickness of said first portion.

10. The sealing ring of claim 1, wherein said wall of said first portion has an outer surface, and wherein no portion of said first portion extends further from the axis of said first portion than the distance between the axis of said first portion and said outer surface of said wall of said first portion.

* * * * *